US005291631A

United States Patent [19]

Schjoneman

[11] Patent Number: 5,291,631

[45] Date of Patent: Mar. 8, 1994

[54] DOOR STOP

[76] Inventor: Craig A. Schjoneman, 135 Foster Cir., Mather AFB, Calif. 95655

[21] Appl. No.: 980,342

[22] Filed: Nov. 23, 1992

[51] Int. Cl.[5] ..... E05F 5/08

[52] U.S. Cl. ..... 16/86 R; 16/82

[58] Field of Search ..... 16/86 R, 86 A, 86 B, 16/82; 292/258, 288, DIG 2, DIG. 11, DIG. 19, DIG. 65

[56] References Cited

U.S. PATENT DOCUMENTS

| | | | |
|---|---|---|---|
| 1,336,527 | 4/1920 | Lewis et al. | 16/86 R |
| 1,520,199 | 12/1924 | Morgan | 16/86 R |
| 2,074,475 | 3/1937 | Jesser | 292/258 |
| 2,480,701 | 8/1949 | Bradbury | 16/86 A |
| 3,124,381 | 3/1964 | Geldart | 292/258 |
| 3,420,399 | 1/1969 | Heisler | 292/258 |
| 3,674,298 | 7/1972 | Vekony | 292/258 |
| 5,004,279 | 4/1991 | Radcliff | 16/82 |
| 5,152,564 | 10/1992 | Martineau | 292/288 |

*Primary Examiner*—Lowell A. Larson
*Assistant Examiner*—Donald M. Gurley
*Attorney, Agent, or Firm*—S. Michael Bender

[57] ABSTRACT

A flexible, rubber-like member in the shape of a flat "dumbbell" has a pair of holes at either enlarged end thereof for fitment respectively about the opposed knobs or handles of a door with the narrow portion thereof wrapping around the side edge of the door proximal the knobs to prevent closure of the door. In an alternatively preferred embodiment, there is provided a signal generating mechanism for indicating when an attempt is being made to close the door with which it is being used.

6 Claims, 4 Drawing Sheets

DOOR STOP

BACKGROUND OF THE INVENTION

1. Field of the Invention

The present invention relates generally to devices for preventing the closure of doors, and more particularly, to a device adapted to be fitted to the handles of a door so as to prevent the door from swinging shut.

2. Description of the Prior Art

Door stops in the form of wedges placed between a door's bottom edge and the floor are age old. Unfortunately, such devices are susceptible of being accidentally kicked free causing a door to close when it is otherwise desired to remain open as, for example, when an infant or child is playing unsupervised in a room and the parent or guardian is in another room or location.

Other prior art attempts at providing a simple, relatively inexpensive yet safe and effective door stop have not been completely successful. Exemplary of these is the door stop shown in U.S. Pat. No. 4,831,688 which shows a one-piece device adapted to be fitted about the edge of a door proximal to the door's hinge so as to serve as a wedge preventing the door from completely closing. This patented device however, is susceptible of being accidentally removed in a relatively easy manner thereby defeating its purpose. Other door stops of various configuration are shown in U.S. Pat. Nos. 4,756,052 (telescopically fitted rods coacting with existing door brace linkage); and 4,462,623 (spring-loaded cylinder in floor recess near door). Also of interest are known devices for engaging doors in one way or another as shown, for example, in U.S. Pat. Nos. 4,181,339 (door knob sleeve of resilient material) and 4,782,553 (bendable door stop screwed into wall).

It is apparent from the above that a need exists for a door stop that may be fitted to a door to maintain the door open and which is not easily removable all of the while being of simple construction and low cost. This need is met by the unique door stop of the present invention as will be made apparent from the following description thereof. Other advantages of the present invention over the prior art also will be rendered evident.

SUMMARY OF THE INVENTION

To achieve the foregoing and other advantages, the present invention, briefly described, provides a flexible, rubber-like member in the shape of a flat "dumbbell" has a pair of holes at either enlarged end thereof for fitment respectively about the opposed knobs or handles of a door with the narrow portion thereof wrapping around the side edge of the door proximal the knobs to prevent closure of the door. In an alternatively preferred embodiment, there is provided signal means for indicating when an attempt is being made to close the door with which it is being used.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least two preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved door stop which has all of the advantages of the prior art and none of the disadvantages.

It is another object of the present invention to provide a new an improved door stop which may be easily and efficiently manufactured and marketed.

It is a further objective of the present invention to provide a new and improved door stop which is of durable and reliable construction.

An even further object of the present invention is to provide a new and improved door stop which is susceptible of a low cost of manufacture with regard to both materials and labor, and which accordingly is then susceptible of low prices of sale to the consuming public, thereby making such door stop available to the buying public.

Still yet a further object of the present invention is to provide a new and improved door stop that once fitted to a door is not easily removed.

It is still a further object of the present invention is to provide a new and improved door stop capable of being fitted to the opposed handles or knobs of a door.

Still a further object of the present invention is to provide a new and improved door stop including signal means for indicating when an attempt is being made to close the door with which it is being used.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 2:
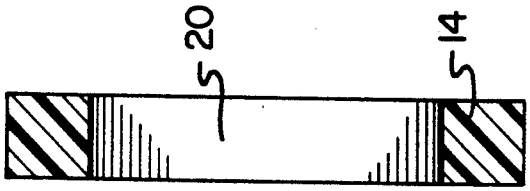
FIG. 2 is a cross-sectional elevational view of the door stop taken along line 2—2 of FIG. 1.
Figure 1:
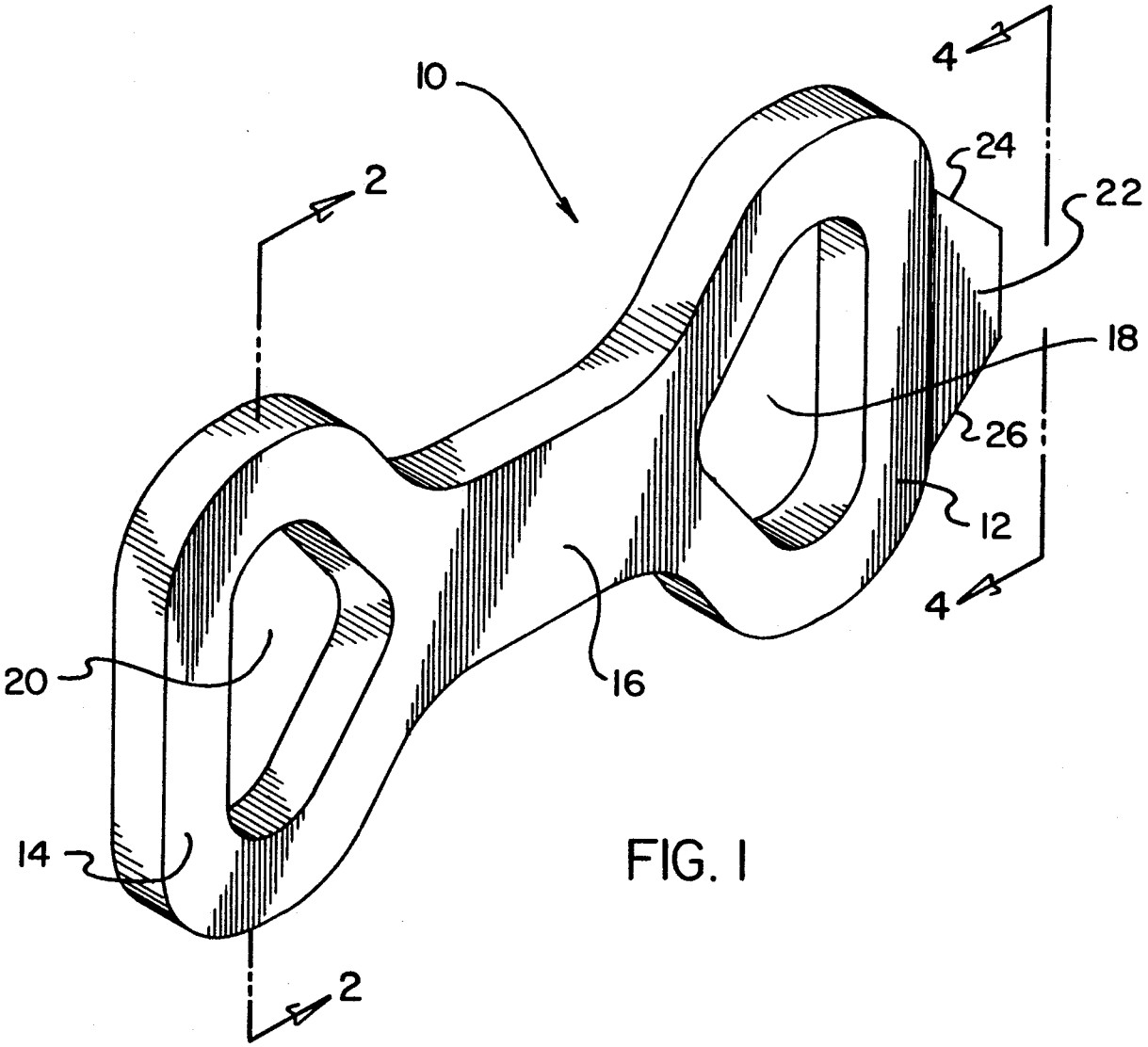
FIG. 1 is a perspective view showing the first preferred embodiment of the door stop of the invention.
Figure 3:
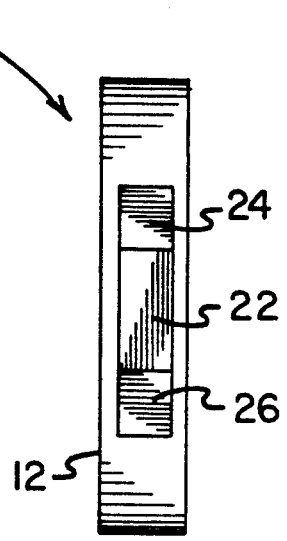
FIG. 3 is an end elevational view of the door stop of FIGS. 1 and 2.

With reference now to the drawings, a new and improved door stop embodying the principles and concepts of the present invention will be described.

Turning initially to FIGS. 1-4, there is shown a first exemplary embodiment of the door stop of the invention generally designated by reference numeral 10. In its preferred form, door stop 10 comprises generally a flat member somewhat in the form of a "dumbbell"; that is, member 10 has a pair of opposed enlarged ends 12, 14 separated and connected by a relatively narrow web 16. Each end 12, 14, in turn, has a generally triangular configuration with its apex proximal to each end of web 16, and with its base defining the distal extremities of the member 10. In addition, each end has a similarly shaped opening 18, 20 therein sized large enough to receive therethrough one of the opposed door handles or knobs of a door. Finally, a tab member 22 of reduced thickness and having sloped side edges 24, 26 is provided integral with one of the distal extremities of member and extending longitudinally or axially therefrom substantially as shown.

Figure 4:
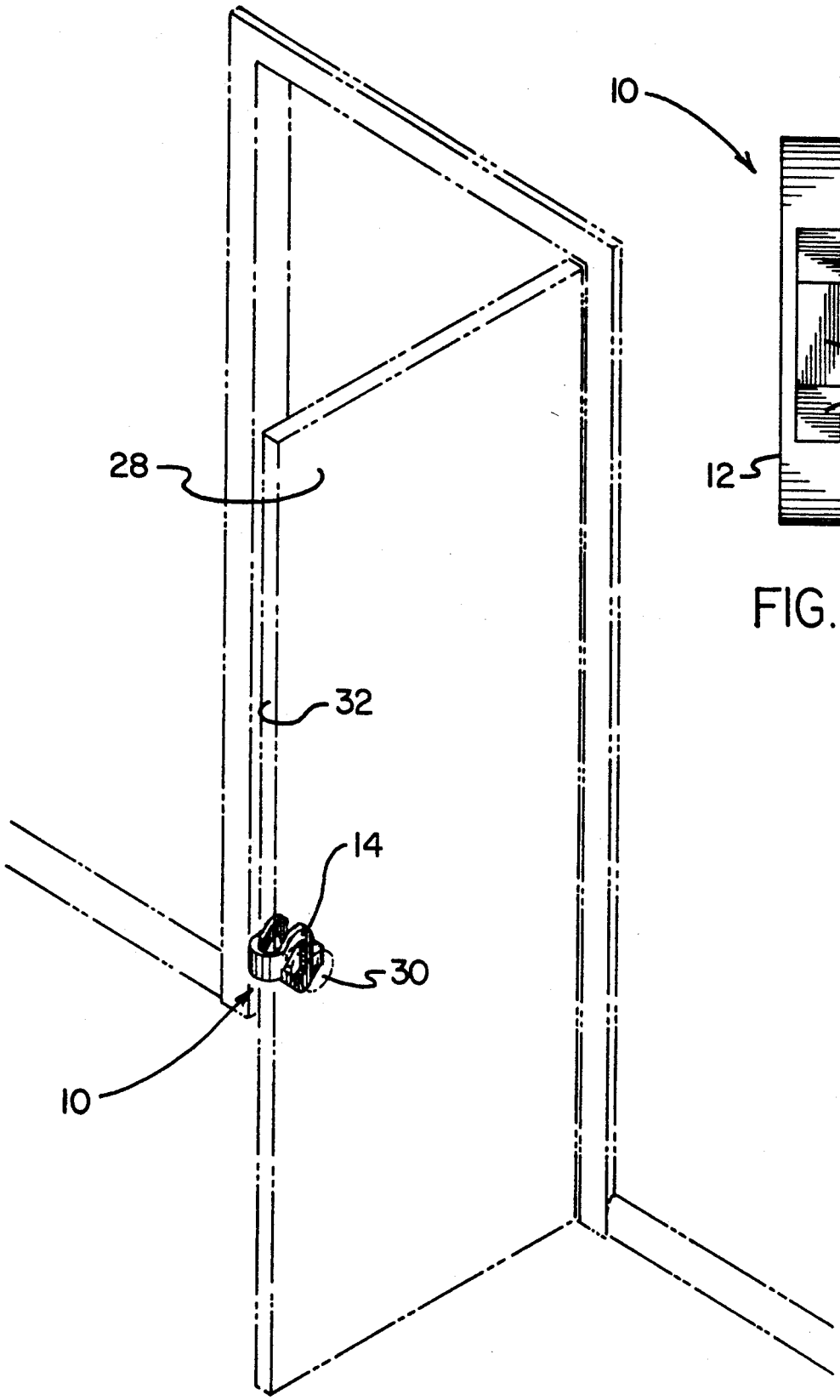
FIG. 4 is a perspective view showing the first preferred embodiment of the invention fitted on a door.
Figure 5:
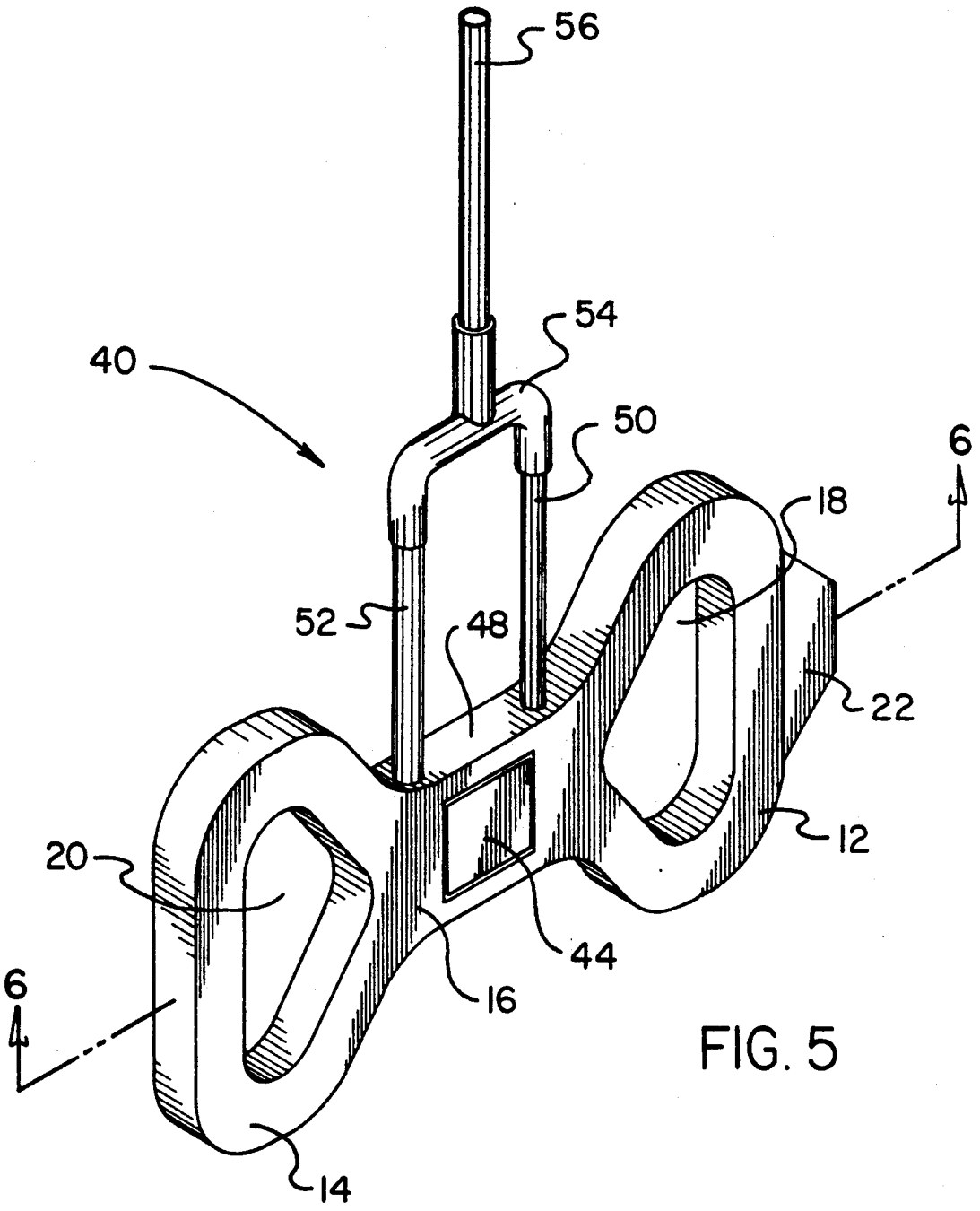
FIG. 5 is a perspective view showing the second preferred embodiment of the door stop of the invention.
Figure 6:
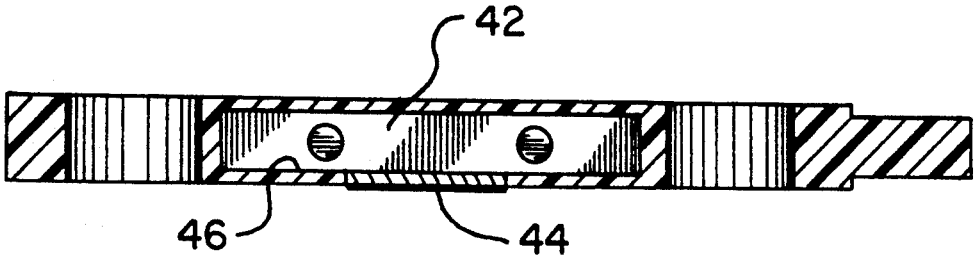
FIG. 6 is a cross-sectional plan view of the door stop of FIG. 5 taken along line 6—6.
Figure 7:
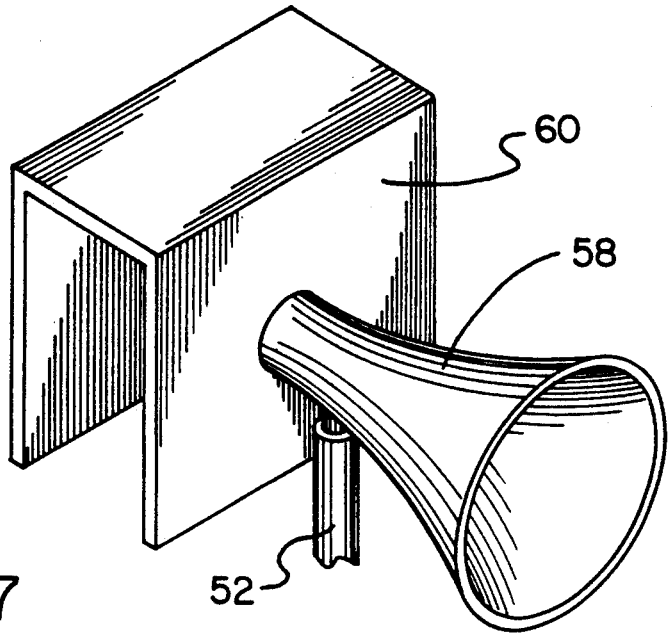
FIG. 7 is a perspective view of a portion of the signal means used with the embodiment of FIGS. 5 and 6.

Door stop member 10 preferably is fabricated of a soft, flexible rubber or rubber like material such as acrylic or other polymeric substance, and is resilient enough so that may be stretched to extend between the opposed door knobs or handles of a door as it is bent about the outside edge of the door. Thus, as best seen in FIG. 4, the door stop member is adapted to be securely fitted to a door 28 by fitting one end 14 over one of the door's knobs 30 (i.e. the knob is passed through opening 20), wrapping the web 16 about the outside edge 32 of the door, and then similarly fitting the other end portion 12 over the other opposed door knob (not shown in FIG. 4). When so fitted, the door stop according to the present invention, and particularly the web section 16 wrapped around the outside edge of the door interferes with the door's frame or jamb thereby preventing the door from closing, pinching fingers possibly locking an infant, child or other person in a room when such would be dangerous or undesirable.

In addition, it will be appreciated that when the door stop is fitted on a door as shown in FIG. 4, the web 16 blocks the sliding locking tongue of the door knob assembly and thus prevents the locking tongue from entering its recess in the door jamb as would be the case in the absence of the door stop. The triangular shape of the openings 18 and 20 facilitates placement and removal of each end portion about its corresponding door knob, and due to its flat shape and flexible character the door stop member's opposed end portions will be engaged securely by the necked-down portions of each door knob assembly adjacent the surface of the door thereby securely maintaining the door stop in position and preventing its easy removal. The length or longitudinal extent of the door stop preferably is such so that it will have to be stretch slightly when the door stop member is fitted in place as shown in FIG. 4. In order to remove the door stop of the invention, all that is necessary is to grasp the tab member 22 and pull one end off its corresponding door knob. If desired, the other end may be left engaged with its corresponding door knob on the reverse side of the door and simply left in a hanging position thereon. This will assure that the door stop always is available for use on a particular door. Obviously, the door stop 10 may be completely removed and used on other doors or stored elsewhere for future use on the same door.

Figure 8:
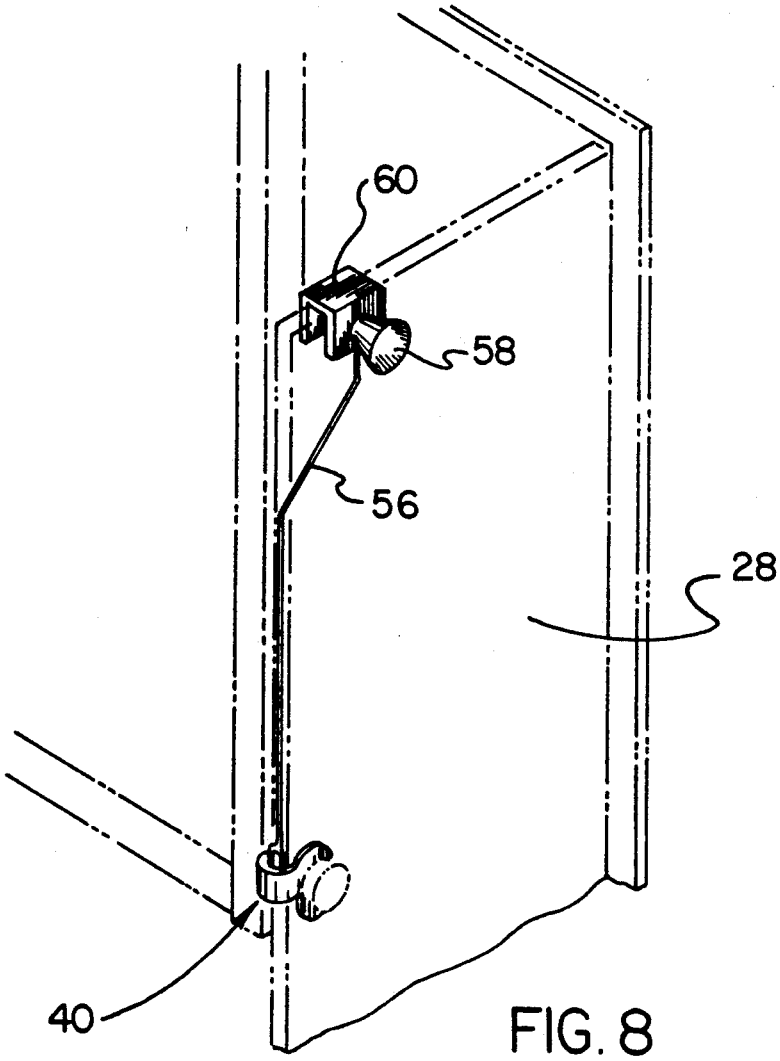
FIG. 8 is a perspective view showing the second preferred embodiment of the door stop of the invention fitted on a door.

When employing the door stop of the present invention to prevent the unintentional or unauthorized closing (or accidental locking) of a door, say, to a room where an infant or child is playing unattended, it would be advantageous if signal means were provided to warn that an attempt was being made to close the door. Such means are provided in the alternatively preferred embodiment of the invention illustrated in FIGS. 5 through 8 and to which reference may now be had. In FIGS. 5 through 8 where like reference numerals refer to like parts already described, there is shown a modified door stop member 40 whose web 16 is hollowed out to form an air cavity 42. Centrally disposed on the web 16 substantially as depicted is a metal plate 44 suitably affixed along its entire periphery to the wall 46 defined by cavity 42 in a manner permitting transverse flexure of the plate, i.e. inwardly toward the interior of the cavity. Extending from the top wall 48 are a pair of hollow air tubes 50, 52 opening into air cavity 42 at the bottom end thereof and connecting with a T-junction 54 at the other end thereof. The output leg of T-junction 54, in turn, is connected to a hollow feed tube 56 which has its distal end suitably connected to the throat of a conventional air horn 58. The air horn is affixed to a U-shaped bracket 60 suitably sized to grip the upper edge 62 of door 28 and support the air horn thereon substantially as shown in FIG. 8. With the parts arranged as illustrated in FIG. 8, an attempt to close door 28 will result in pressure against web 16 and depression of metal plate transversely toward the center of air cavity 42. By this action, air will be compressed in cavity 42 flow through tubes 50, 52, thence through T-junction 54 and feed pipe 56 whereupon the air horn will be activated sounding a loud distinctive warning signal and alerting a parent in another room that a child is attempting to close the door where the child is situated unattended.

It is apparent from the above that the present invention accomplishes all of the objectives set forth by providing a new and improved door stop that is simple in construction, low in cost, that may be securely anchored to the knobs of a door so that removal thereof by a child or the like is impeded, and which in modified form includes means for signaling when an attempt is being made to close the door.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by letters patent of the United States is as follows:

1. A new and improved door stop comprising:

a substantially flat member having a pair of opposed end portions and a central portion extending between and connecting said pair of end portions, each of said pair of end portions having an opening therein, said member being flexible whereby each of said end portions may be fitted in a bent manner about the edge of a door proximal to a pair of opposed door knobs on said door with each of said end portions adapted to engage a corresponding door knob through its associated opening, respectively, and wherein said door stop further includes means for generating a signal when said door stop is fitted on said door and an attempt is made to close said door, and a signal device on said door responsive to said means for generating a signal.

2. The door stop of claim 1 further comprising a tab member extending from one of said end portions.

3. The door stop of claim 1 wherein said end portions are enlarged relative to said central portion whereby said member has a shape resembling that of a flat dumbbell.

4. The door stop of claim 3 wherein said openings in said end portions are triangularly shaped.

5. The door stop of claim 1 wherein said member is of rubber or a rubber like material.

6. The invention of claim 1 wherein said means for generating a signal comprises an air chamber in said central connecting portion, depressible plate means on said central portion communicating with said chamber, conduit means extending between said chamber and said signal device, and means for mounting said signal device on said door.

* * * * *